US006964235B2

(12) United States Patent
Hardy

(10) Patent No.: US 6,964,235 B2
(45) Date of Patent: Nov. 15, 2005

(54) PRODUCT MANAGEMENT DISPLAY SYSTEM

(75) Inventor: Stephen N. Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 141 days.

(21) Appl. No.: 10/474,490

(22) PCT Filed: May 17, 2002

(86) PCT No.: PCT/US02/15760

§ 371 (c)(1),
(2), (4) Date: Oct. 8, 2003

(87) PCT Pub. No.: WO02/091885

PCT Pub. Date: Nov. 21, 2002

(65) Prior Publication Data

US 2004/0118794 A1 Jun. 24, 2004

Related U.S. Application Data

(60) Provisional application No. 60/291,732, filed on May 17, 2001.

(51) Int. Cl.[7] ..... A47B 57/00
(52) U.S. Cl. ..... 108/61; 211/184
(58) Field of Search ..... 108/61, 60; 211/184, 211/183, 59.3, 43, 11

(56) References Cited

U.S. PATENT DOCUMENTS

| | | | | |
|---|---|---|---|---|
| 2,085,470 A | | 8/1937 | Shaffer et al. | |
| 2,110,299 A | | 3/1938 | Hinkle | |
| 2,111,496 A | | 3/1938 | Scriba | |
| 3,083,067 A | | 3/1963 | Vos et al. | |
| 3,285,429 A | | 11/1966 | Propst | |
| 3,308,961 A | | 3/1967 | Chesley | |
| 3,348,732 A | | 10/1967 | Schwarz | |
| 3,452,899 A | | 7/1969 | Libberton | |
| 3,652,154 A | | 3/1972 | Gebel | |
| 3,698,568 A | * | 10/1972 | Armstrong | 211/184 |
| 3,815,519 A | | 6/1974 | Meyer | |
| 3,830,169 A | | 8/1974 | Madey | |
| 3,868,021 A | | 2/1975 | Heinrich | |
| 4,300,693 A | | 11/1981 | Spamer | |
| 4,303,162 A | | 12/1981 | Suttles | |
| 4,331,243 A | | 5/1982 | Doll | |

(Continued)

FOREIGN PATENT DOCUMENTS

| | | |
|---|---|---|
| CH | 412 251 | 4/1968 |

(Continued)

*Primary Examiner*—Jose V. Chen
(74) *Attorney, Agent, or Firm*—Banner & Witcoff, Ltd.

(57) ABSTRACT

An integrated "T" assembly (500) combines into a single integrated assembly, a track portion along both sides of a divider (504). The T assembly may have a wide-base portion (518), which may include a spring-urged-pusher track, on one side of the divider and a narrow-base portion (520) on the opposite side of the divider. An offset pusher (700) may have an upper portion that is offset, via an angled offset portion, from a lower portion of the pusher. Additional supporting bases, any of which may include spring-urged-pusher tracks and/or a spring-urged pusher, may be used under a wide product. Left and right side finisher (600) components may be paired with T assemblies near the sides of a merchandise-display shelf. The T assembly, base, and/or end finishers may be coupled to a front rail via a complimentary tongue and groove arrangement and/or a non-slidable engagement, such as mating teeth.

46 Claims, 12 Drawing Sheets

U.S. PATENT DOCUMENTS 4,467,927 A 8/1984 Nathan
4,482,066 A 11/1984 Dykstra
4,504,100 A 3/1985 Chaumard
4,615,276 A 10/1986 Garabedian
4,685,574 A 8/1987 Young et al.
4,706,821 A 11/1987 Kohls et al.
4,724,968 A 2/1988 Wombacher
4,729,481 A 3/1988 Hawkinson et al.
4,730,741 A 3/1988 Jackle, III et al.
4,762,236 A * 8/1988 Jackle et al. ..... 211/59.3
4,830,201 A 5/1989 Breslow
4,836,390 A 6/1989 Polvere
4,899,668 A * 2/1990 Valiulis ..... 108/61
4,907,707 A 3/1990 Crum
4,934,645 A 6/1990 Breslow
5,012,936 A 5/1991 Crum
5,027,957 A 7/1991 Skalski
5,111,942 A 5/1992 Bernardin
5,123,546 A 6/1992 Crum
5,148,927 A * 9/1992 Gebka ..... 211/184
5,161,702 A 11/1992 Skalski
5,190,186 A 3/1993 Yablans et al.
5,265,738 A 11/1993 Yablans et al.
5,341,945 A 8/1994 Gibson
5,366,099 A 11/1994 Schmid
5,390,802 A 2/1995 Pappagallo et al.
5,450,969 A 9/1995 Johnson et al.
5,458,248 A * 10/1995 Alain ..... 211/175
5,464,105 A 11/1995 Mandeltort
5,469,976 A * 11/1995 Burchell ..... 211/59.3
5,542,552 A 8/1996 Yablans et al.
5,562,217 A 10/1996 Salveson et al.
5,634,564 A 6/1997 Spamer et al.
5,673,801 A 10/1997 Markson
5,685,664 A 11/1997 Parham et al.
5,738,019 A 4/1998 Parker
5,746,328 A 5/1998 Beeler et al.
5,839,588 A 11/1998 Hawkinson
6,006,678 A * 12/1999 Merit et al. ..... 108/60
6,041,720 A 3/2000 Hardy
6,142,317 A 11/2000 Merl
6,227,385 B1 * 5/2001 Nickerson ..... 211/59.3
6,622,874 B1 * 9/2003 Hawkinson ..... 211/59.3
6,655,536 B2 * 12/2003 Jo et al. ..... 211/59.3

FOREIGN PATENT DOCUMENTS

DE 28 25 724 A1 12/1979
DE 299-02688 U1 7/1999
EP 0 337 340 10/1989
EP 0 398 500 A1 11/1990
EP 0 454 586 B1 10/1991
EP 0 779 447 B1 4/2000
FR 2 385 365 10/1978
GB 2 027 339 A 2/1980
GB 881700 11/1981
GB 2 283 407 A 5/1995
WO WO 91/15141 A 10/1991

* cited by examiner

PRODUCT MANAGEMENT DISPLAY SYSTEM

CROSS REFERENCE TO RELATED APPLICATIONS

This application claims priority to provisional U.S. Application Ser. No. 60/291,732, filed May 17, 2001, entitled Product Management Display System.

FIELD OF THE INVENTION

The invention relates to a system for displaying, pushing, and dividing merchandise on merchandise-display shelves.

BACKGROUND OF THE INVENTION

It is desirable to have merchandise on a shelf situated toward the front of the shelf so that the merchandise is visible and accessible to shoppers. Thus, as merchandise is removed from a shelf, it may be advantageous to push the remaining merchandise toward the front of the shelf. It may also be desirable to include dividing panels, also referred to as dividers, to separate merchandise into rows on a display shelf.

Commonly assigned U.S. Pat. No. 6,041,720 ("the '720 patent") discloses a product management display system that may be used for dividing and pushing displayed merchandise.

DE 299-02,688 U1 discloses a merchandise display system in which a base-and-divider assembly is constructed as two separate units that need to be connected to each other before being used. When the system of D1 is used with products having different sizes, product slider guides, also referred to herein as pusher tracks, of various widths need to be used to accommodate the different sizes of the products.

U.S. Pat. No. 5,265,738 discloses a merchandise display system with a pusher track that has an integrated divider wall on one side of the pusher track. Like the system disclosed by DE 299-02,689 U1, pusher tracks having different widths must be used to accommodate products of different sizes.

Referring to FIG. 1 of the '720 patent, various components, such as pusher end device 150, pusher divider 152, and pusher 154 mounted on bases 166, 212, and 232, respectively, are disclosed for mounting onto either shelf frame 25 or standard dealer shelf 40. The pusher end device 150, the pusher divider 152, and the pusher 154, which are mounted to bases 166, 212, and 232, of FIG. 1 of the '720 patent were designed with ultimate flexibility in mind. This flexibility allows these components to be assembled and used in many different ways depending on the particular product to be displayed. This presents store personnel with potentially confusing choices, which may lead to frustration, wasted time, and incorrectly installed parts. Three pusher components, namely, a fill-width track, which can accept the pushing device, a divider, and a narrow track, are typically used together more often than other combinations of components. Therefore, a component that combines these devices into a single integrated assembly would be desirable.

SUMMARY OF THE INVENTION

An integrated "T" assembly, also referred to as a base-and-divider assembly, in accordance with an illustrative embodiment of the invention combines into a single integrated assembly, a full-width track, a divider, and a narrow trace A narrow and strong end-finisher piece may be used to provide a second divider-like partition and, optionally a wide or narrow track, for pairing with a T assembly's narrow-track or wide-track portion near an end of either side of a shelf.

In accordance with an illustrative embodiment of the invention, a spring-urged offset pusher may have an upper portion that is offset, via an angled offset portion, from a lower portion of the pusher. The upper offset portion may advantageously extend farther out toward the center of various products to be displayed. Such an offset pusher may allow for using a minimal number of components while still pushing products relatively near to their centers, having the advantage of pushing them smoothly with less binding. When displaying a wide product, one or more supporting tracks, any of which may have a pusher, may be used under the product In accordance with an illustrative embodiment of the invention, a T assembly and/or a full track may be coupled to a front rail via a complimentary tongue and groove arrangement. Any of the components having a divider panel, such as a T assembly, an end finisher, and a full-width track, may also contain any of various engagement mechanisms for non-slidably engaging with a front rail's corresponding engagement mechanism. For instance, teeth on a base may engage corresponding teeth on the front rail. Teeth of this type advantageously allow a T assembly, full-width track, and/or end finishers with corresponding teeth to be located at positions virtually continuously along the front rail and may prevent the components from being moved unintentionally from their intended positions during normal shopping activity and shelf re-stocking.

In accordance with an illustrative embodiment of the invention, a T assembly may include a tear-off line and a break-off line. Such a tear-off line and break-off line combination may be used to advantage to produce one part that may be used for shelves having different depths, such as either 16 inches or 10 inches.

In accordance with an illustrative embodiment of the invention, a pusher track may include a depression, which may be used while re-stocking merchandise to hold a pusher near the back of a frill-width track or T assembly. To use the depression to hold a pusher at the back of the track, a person may move the pusher back to the depression and may tilt the top of the pusher toward the front of the track. Merchandise may be re-stocked without having to manually hold the pusher out of the way. To remove the pusher from the depression, the pusher may be pushed toward the back of the track, the pusher will then return to an upright position and move along the track in its usual way.

In accordance with an illustrative embodiment of the invention, front edges of the respective surfaces that the pusher travels along may automatically engage a bent portion of the pusher's coiled spring when the pusher is inserted onto the front of the track.

Additional features and advantages of the invention will be apparent upon reviewing the following detailed description.

DETAILED DESCRIPTION OF THE INVENTION

Figure 1:
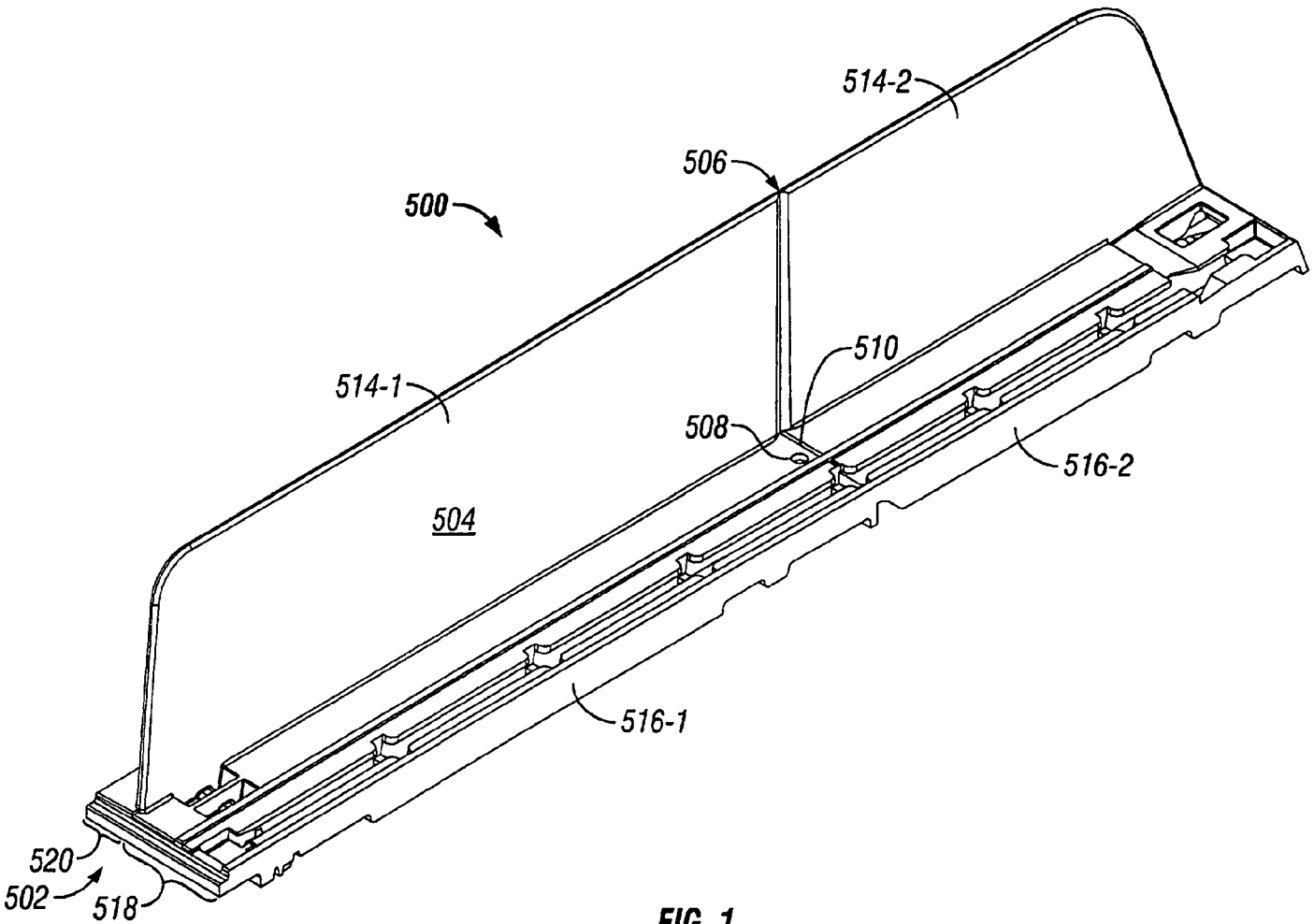
FIG. 1 depicts an integrated "T" assembly, also referred to as a base-and-divider assembly, in accordance with an illustrative embodiment of the invention.
Figure 5:
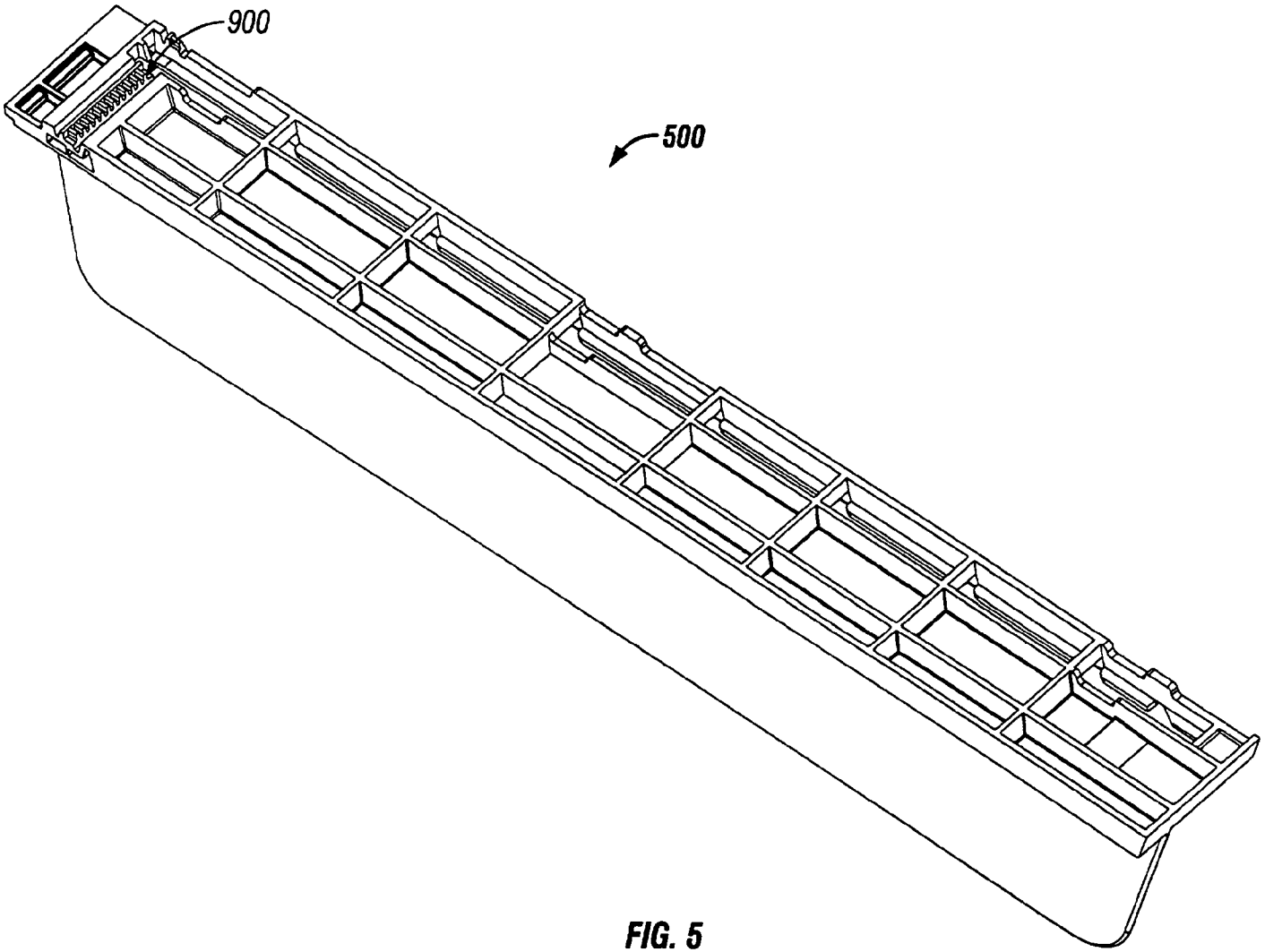
FIG. 5 is perspective view of the bottom of a T assembly in accordance with an illustrative embodiment of the invention.

FIG. 1 depicts an integrated "T" assembly 500 in accordance with an illustrative embodiment of the invention. The "T" refers to the appearance of the T assembly 500 as viewed in the direction of arrow 502 in FIG. 5. T assembly 500 would actually look like an upside-down (and off-center) T, but for the sake of brevity, it is referred to simply as a T assembly. The T assembly may also be referred to as a base-and-divider assembly. The T assembly essentially combines into a single assembly, a first track, a divider, and a second track. In accordance with an illustrative embodiment of the invention, the divider portion 504, the first portion 518 of the base, and the second portion of the base 520 may be manufactured as a single integrated component.

In accordance with an illustrative embodiment of the invention shown in FIG. 1, a divider 504 may divide the base of the T assembly 500 into a first portion 518 and a second portion 520. The first portion 518 of the base may be referred to as a wide portion of the base and the second portion 520 may be referred to as a narrow portion 520 of the base 500. As will be apparent any suitable ratio of widths may be chosen for the first and second portions of the base. For instance, the divider 504 may bisect the base such that the base's first and second portions are of a substantially equal width.

T assembly 500 may have a relatively thick and rigid divider 504 to prevent deflection that might occur when pushing round or triangular objects. Deflection of this type could cause those objects to slip by one another or not to push well in general. In FIG. 1, rigid divider 504 includes two parts, 514-1 and 514-2, which are described below.

Figure 2:
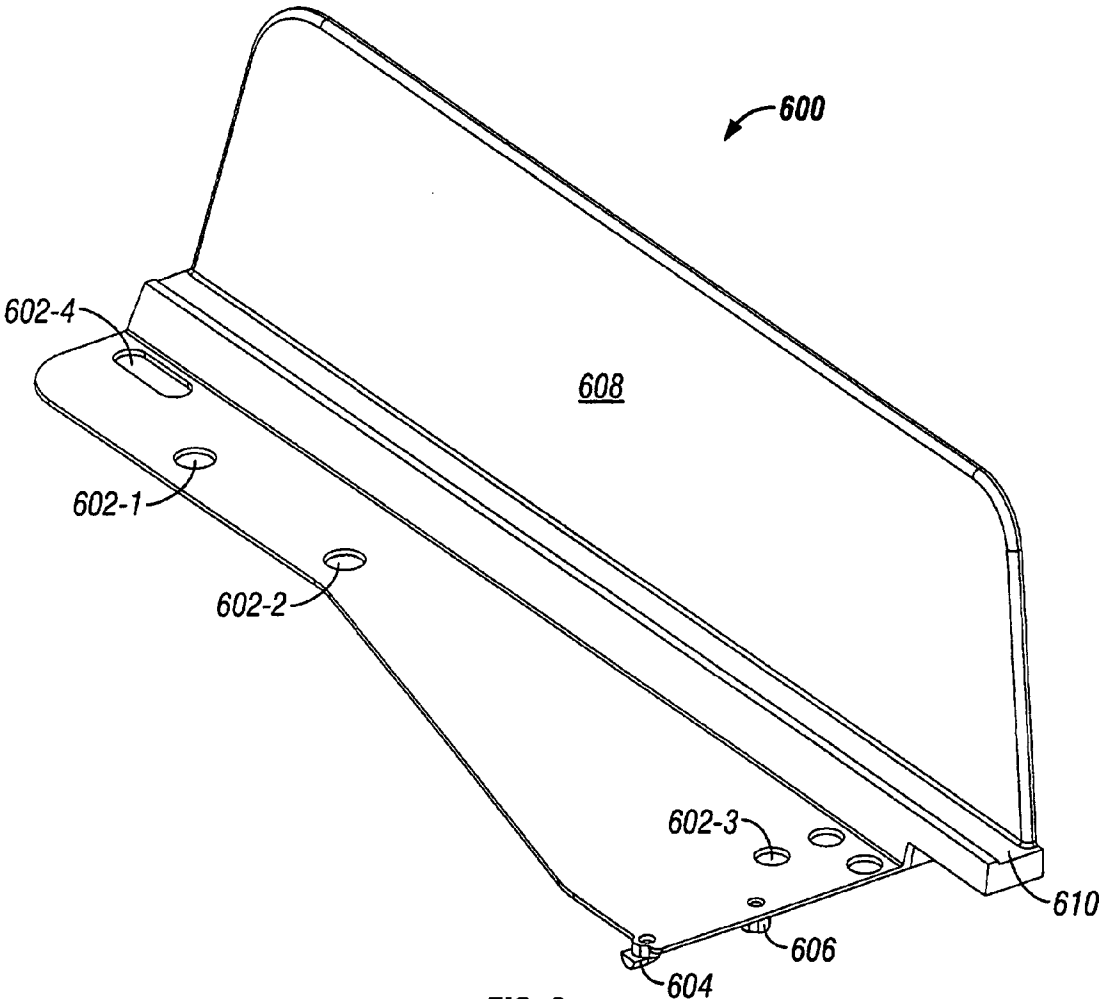
FIG. 2 depicts a right end component in accordance with an illustrative embodiment of the invention.

At either end of a shelf using the pusher components, a narrow and strong end-finisher component is desirable. Referring to FIG. 2, a right-end component 600 may be fastened to a shelf near the right-hand side of the shelf. The right-end component's divider 608 may act the right-most divider on the shelf. The right-end component 600 may be operatively coupled to a shelf by inserting pegs 604 and 606 through corresponding holes in a shelf. One or more fasteners, such as plastic push-rivets, may be used through holes 602-1 through 602-4, and corresponding holes in a shelf, to securely fasten the right-end component to the shelf.

Figure 11:
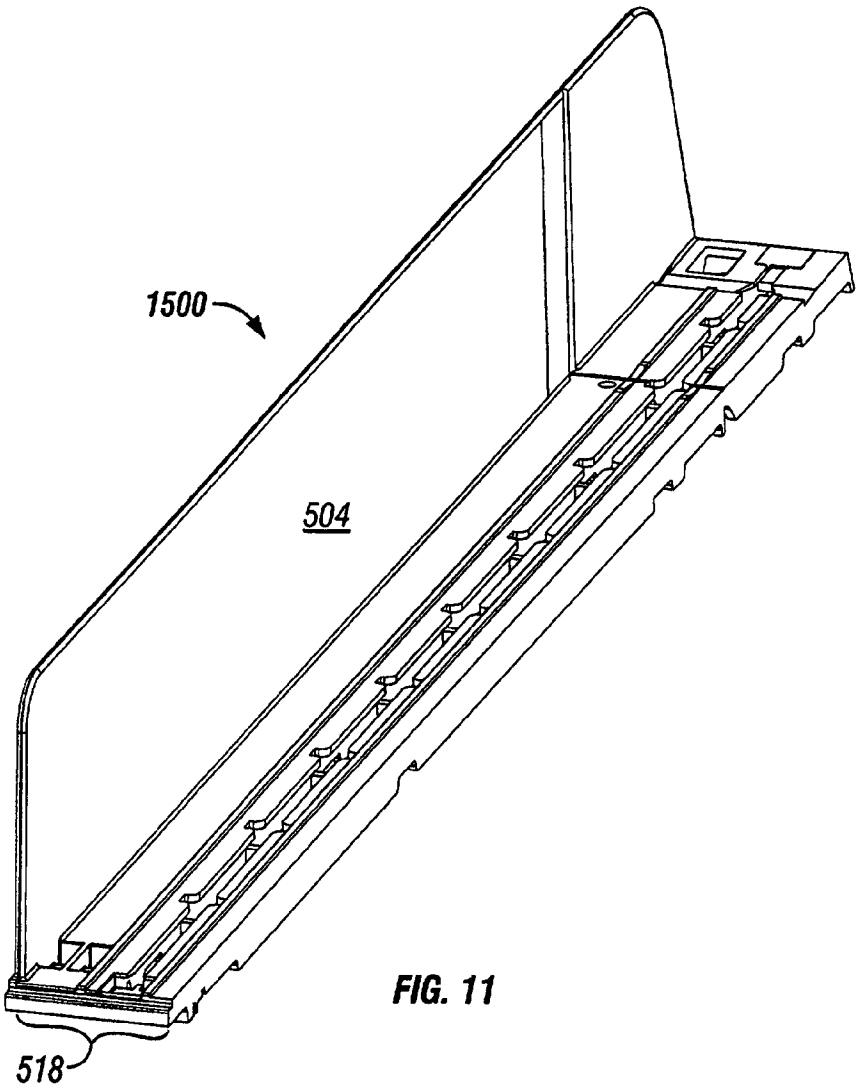
FIG. 11 depicts an integrated end component in accordance with an illustrative embodiment of the invention.

The right-end component shown in FIG. 2 is intended to be placed at a fixed location near the right side of a shelf's top surface. Referring to FIG. 11, a left-end component 1500 may be similar to a T assembly 500 except that, for the left-end component 1500 the portion of the T assembly's base to the left of the divider is omitted. Accordingly, the left-end component 15, may include a divider 504 and a base portion 518. Because the right-end component is intended to have a fixed location and the other components may have adjustable positions along a rail near the front of a shelf, components may be placed onto the shelf and the front rail from right to left to allow for maximum flexibility in adjusting the distances between the components.

Figure 3:
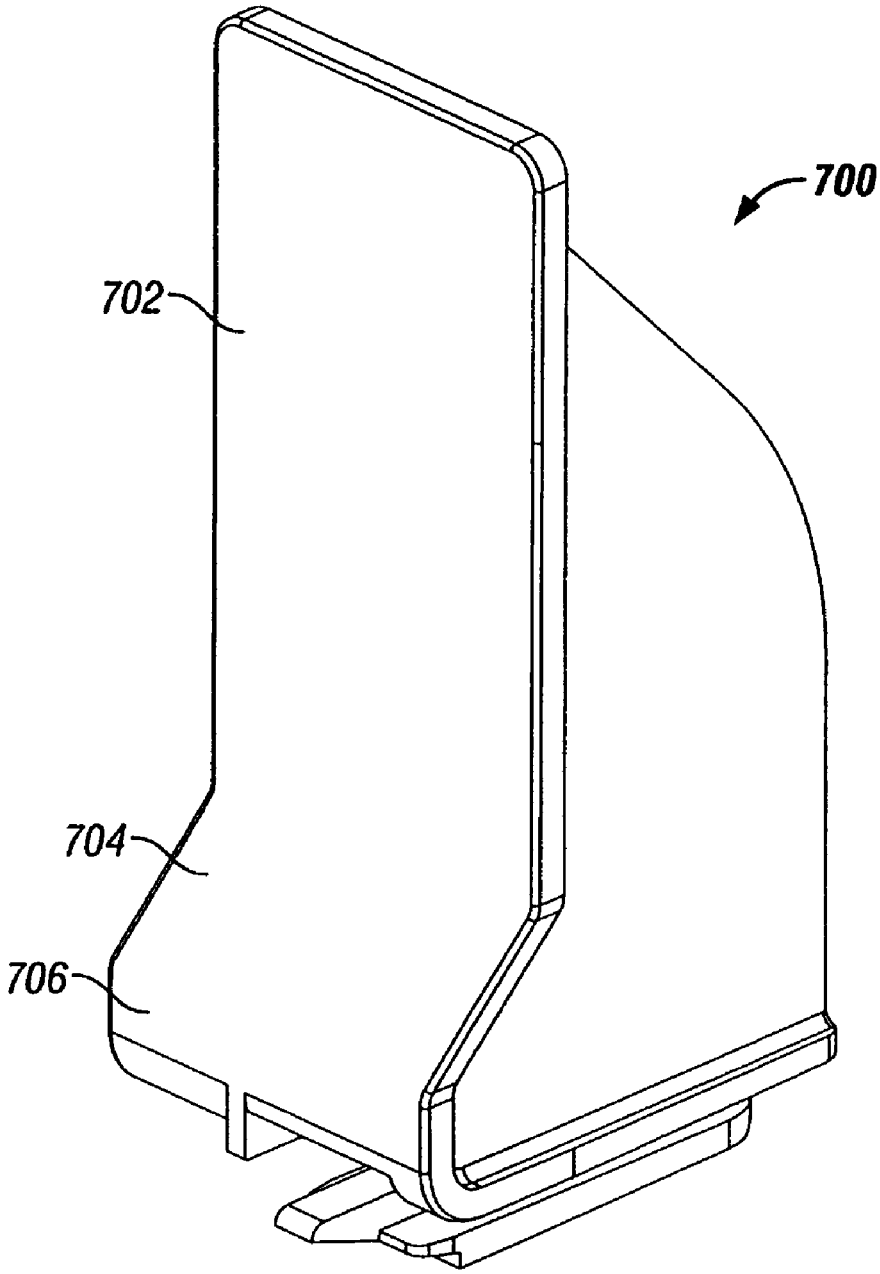
FIG. 3 shows an offset pusher in accordance with an illustrative embodiment of the invention.
Figure 10:
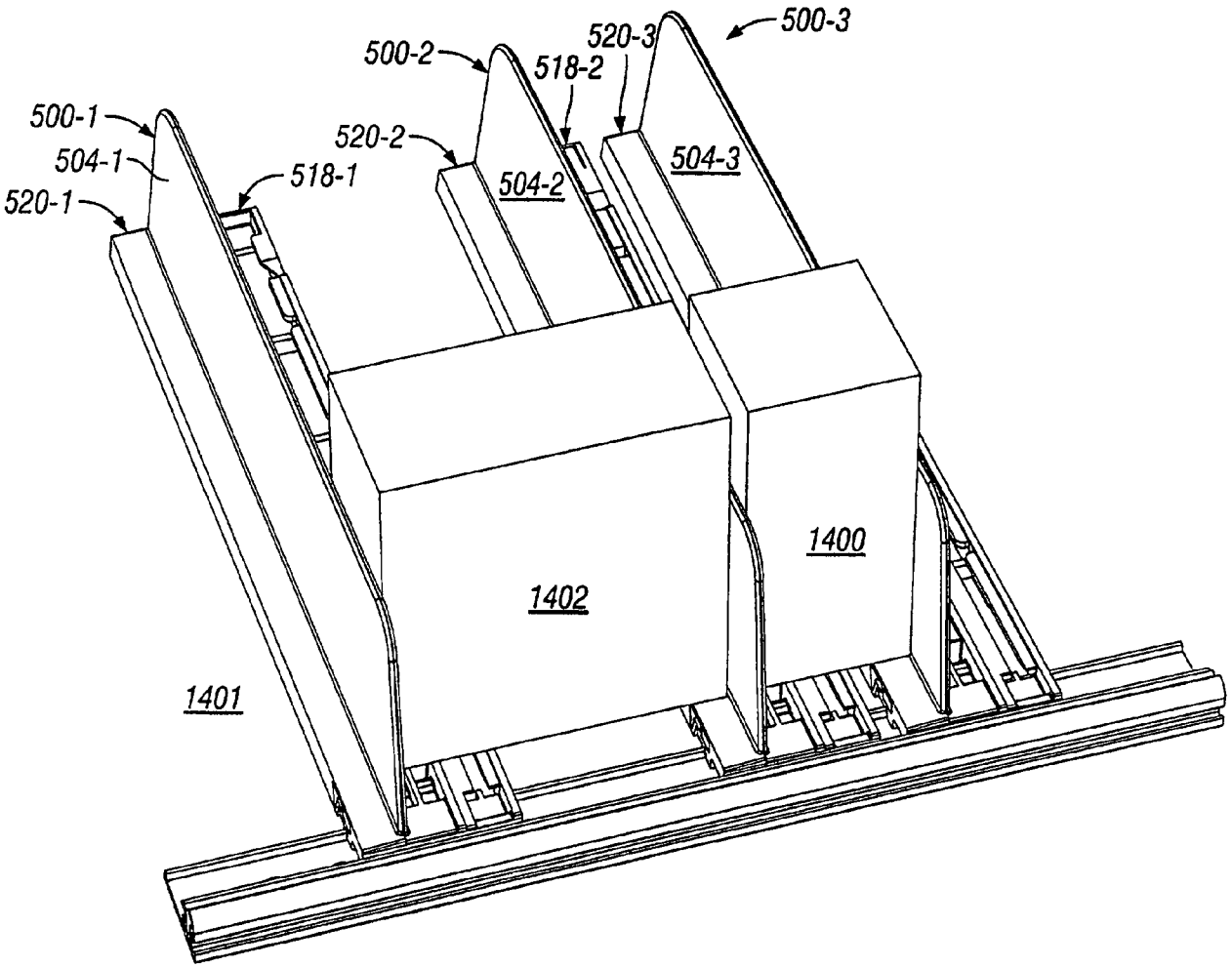
FIG. 10, depicts products of different sizes on multiple T assemblies.

The width of many products, such as deodorants, analgesics, antihistamines, would allow a minimum number of pusher and base components to be used, spaced laterally apart from each other along a shelf, but the pushers may undesirably end up sufficiently off-center such that the products do not get pushed well. For instance, referring to FIG. 10, multiple T assemblies 500-1 through 500-3 are shown operatively coupled to a shelf 1401 via a front rail. A relatively narrow product 1400 is shown being supported by the wide portion 518-2 of the base of T assembly 500-2 and by the narrow portion 520-3 of the T assembly 500-3. T assemblies 500-2 and 500-3 are positioned relatively close to each other because product 1400 is relatively narrow. Product 1402, however, is relatively wide. T assembly 500-1, therefore, is spaced relatively far away from T assembly 500-2. The product 1402 is supported by the narrow portion 520-2 of the base of the T assembly 500-2 and the wide portion 518-1 of the base of the T assembly 500-1. Because the pusher track and pusher of the T assembly 500-1 are located relatively close to the divider 504-1 of T assembly 500-1, an offset pusher, such as the offset pusher 700 (FIG. 3) may be used so that the offset portion 702 may be positioned closer to the center of a relatively wide product, such as product 1402. Offset pusher 700 has an upper portion 702 that is offset, via an offset portion 704, from a lower portion 706 of the pusher 700. Upper offset portion 702 advantageously extends farther out toward the center of various products to be displayed. The offset pusher allows for using a minimal number of components while still pushing products relatively near to their centers.

Occasionally a product is too wide to use only T assemblies 500 on either side of the product. Under these circumstances, one or more supporting tracks may be used under the product. In addition, a product may be unusually dense and/or heavy such that the product requires another track with an additional pusher to move the product. Under these circumstances, a full-width track, such as full-width track 800, shown in FIG. 4 and also referred to as a base, may be used either with or without a pusher 700.

Figure 8:
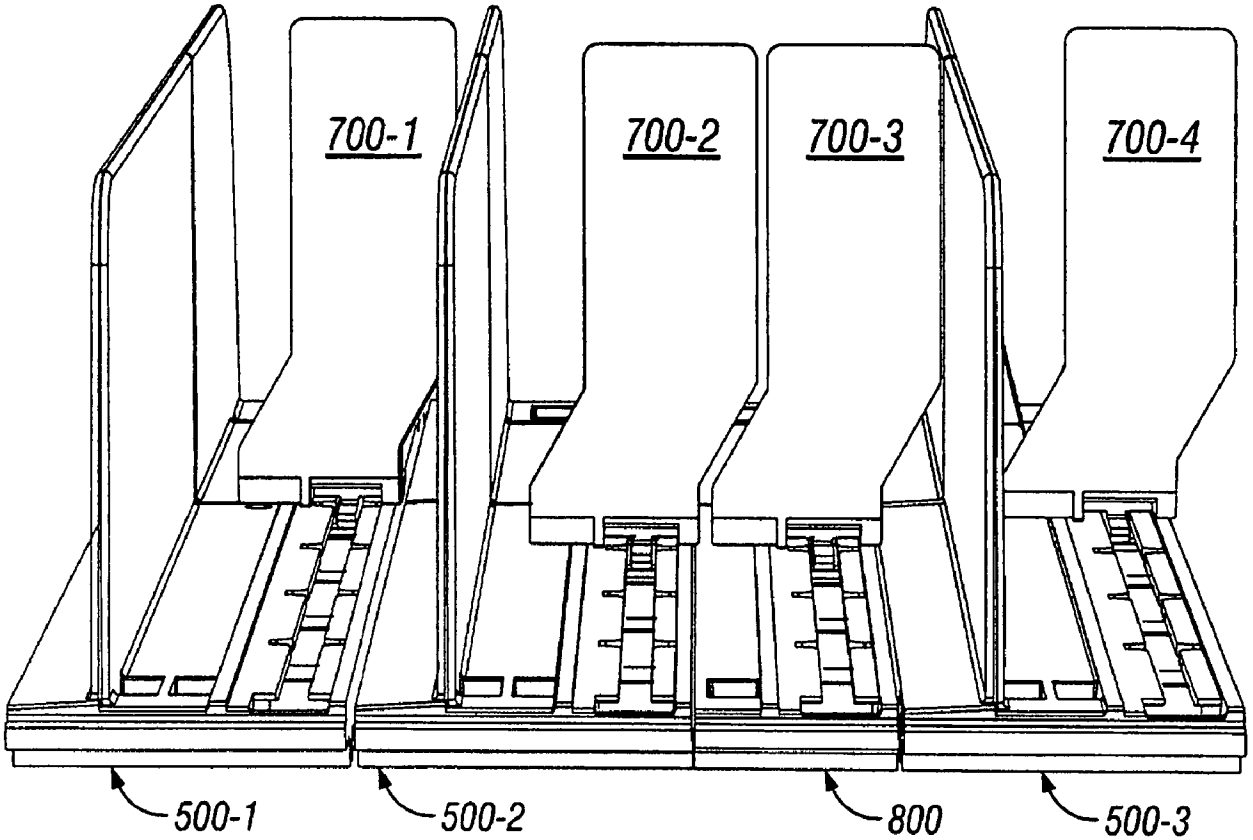
FIG. 8 depicts a full-width track with a pusher between two T assemblies in accordance with an illustrative embodiment of the invention.

For instance, FIG. 8 depicts a full-width track 800 with a pusher 700-3 between two T assemblies 500-2 and 5003 with pushers 700-2 and 700-4 to the left and right sides, respectively, of the full-width track 800.

Figure 6:
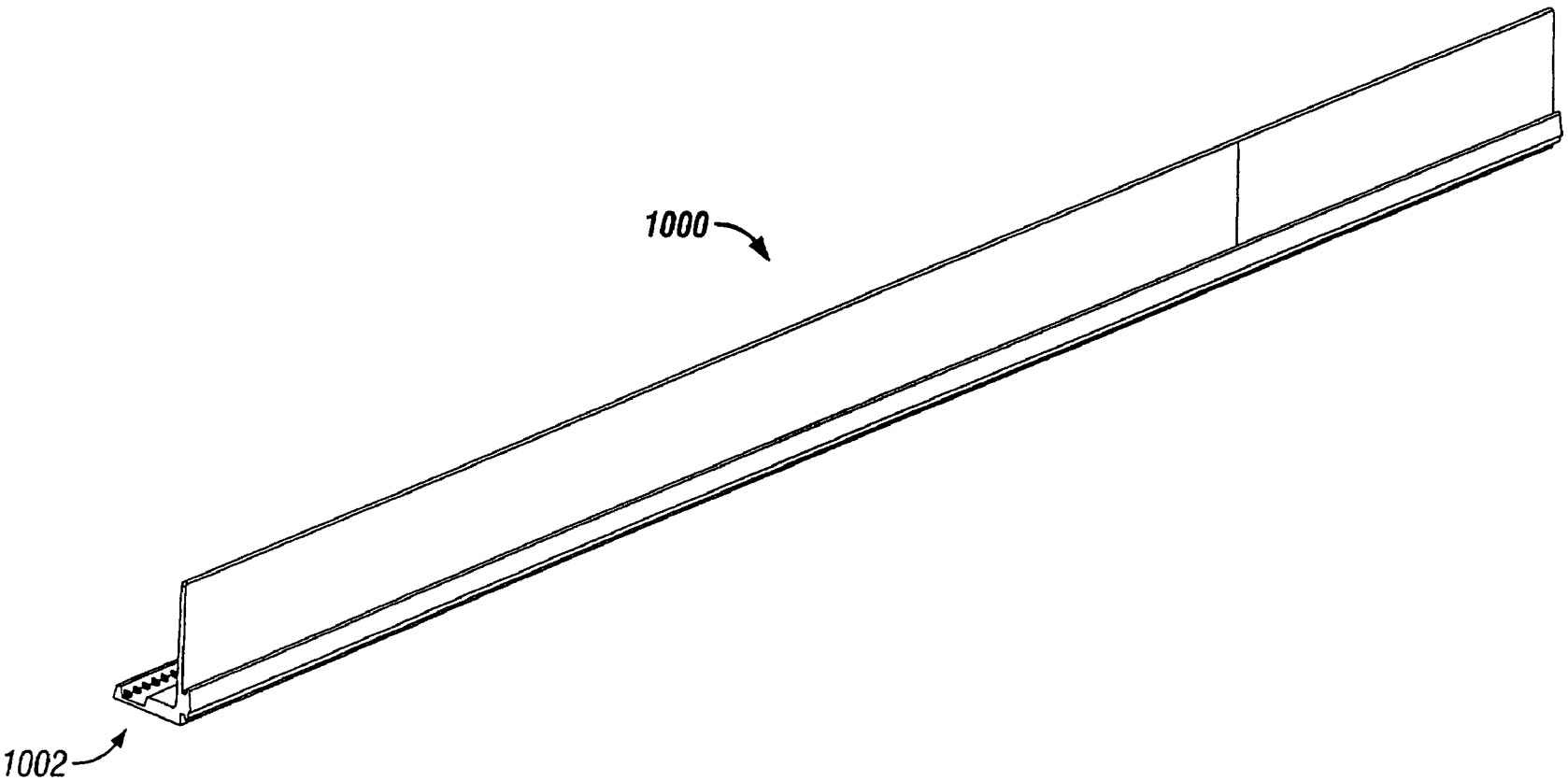
FIG. 6 is a perspective view of a front rail in accordance with an illustrative embodiment of the invention.
Figure 7:
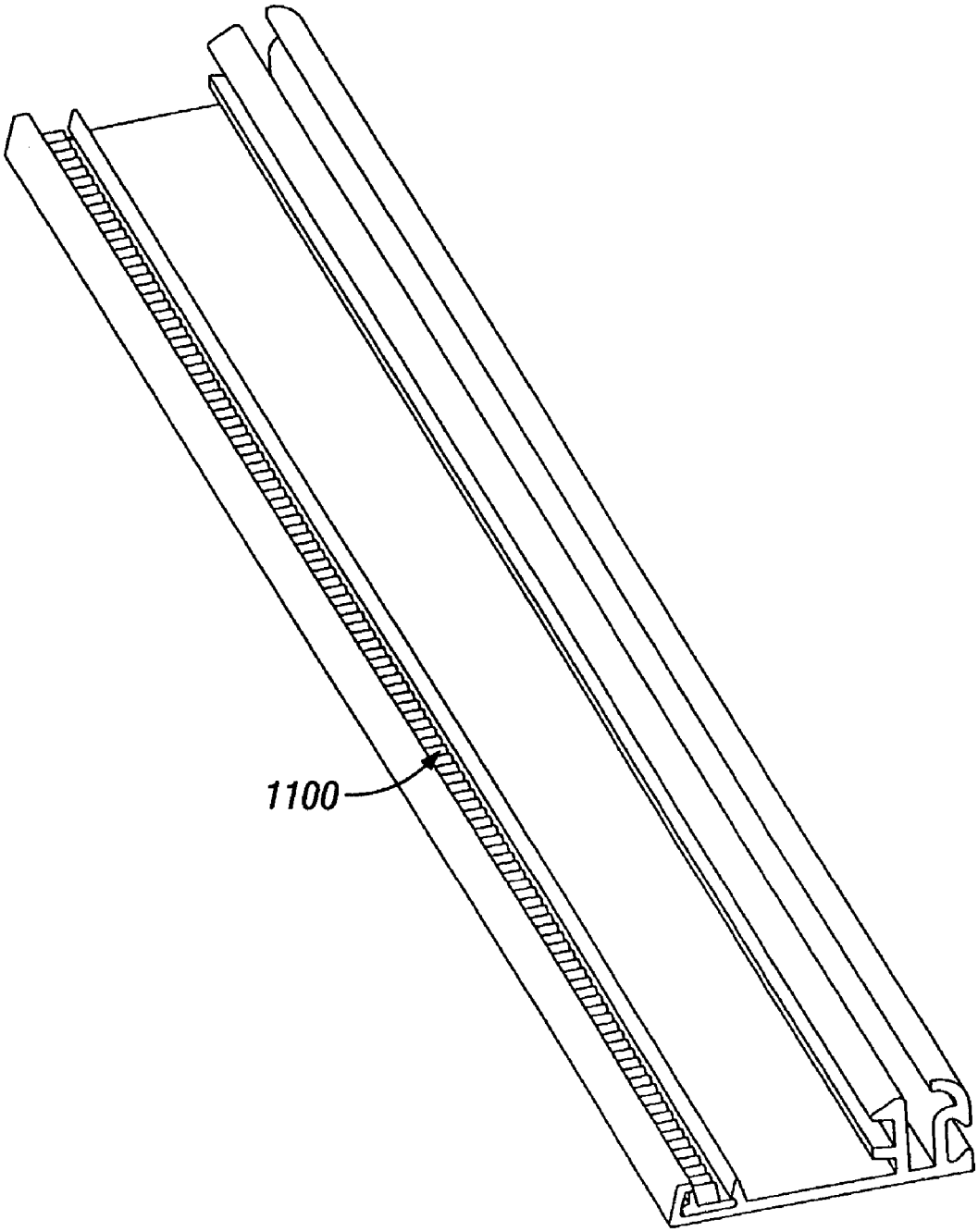
FIG. 7 is an enlarged oblique side view of the front rail of FIG. 7 in accordance with an illustrative embodiment of the invention.

In accordance with an illustrative embodiment of the invention, any of the components, which have a divider and/or a pusher track, may be coupled to a front rail via a complimentary tongue and groove arrangement as disclosed in the '720 patent. The T assembly 500 and full track 800 may non-slidably engage each other. For instance, teeth 900, shown in FIG. 5, may engage a corresponding non-slidable engagement detail in a front rail, such as front rail 1000 shown in FIG. 6. FIG. 7 is an enlarged oblique side view of the front rail 1000, viewed from the direction indicated by arrow 1002 in FIG. 6. Teeth 1100 allow a T assembly 500, full-width track 800, and/or a left-end component with corresponding teeth to be located at virtually continuous positions along the front rail. The mating teeth may be relatively thin and closely spaced to allow for precise placement of pusher-track components. The teeth advantageously prevent the components from being unintentionally moved from their intended positions during normal shopping activity and shelf re-stocking.

As will be apparent, other ways of positively engaging T assembly 500, full-width track 800, and/or a left-end component with the front rail may also be used. For instance, serrations on the front rail could bite into the bottom of the pusher-track components. A compression fit arrangement could be used in which a tongue of the pusher-track component snaps into the front rail. The front rail could have rubber in a groove that would receive a serrated tongue of a pusher-track component.

Referring again to FIG. 1, the T assembly 500 may optionally include a tear-off line, such as tear-off line 506, and a break-off line, such as break-off line 510. Such a tear-off line and break-off line combination may be used to advantage to produce one part that may be used for shelves having different depths, such as either 16 inches and 10 inches. Tear-off line 506 allows tearing of the vertically oriented divider pieces 514-1 and 514-2 as a first operation. This tearing operation may then be followed by a breaking operation to separate track piece 516-1 from track piece 516-2. The combination of the tear-off line and the break-off line facilitates removal of the rear portion of the T assembly 500. As will be apparent, a full-width track and/or a right-end finisher may also optionally include a break-off line analogous to the break-off line 510.

Figure 9:
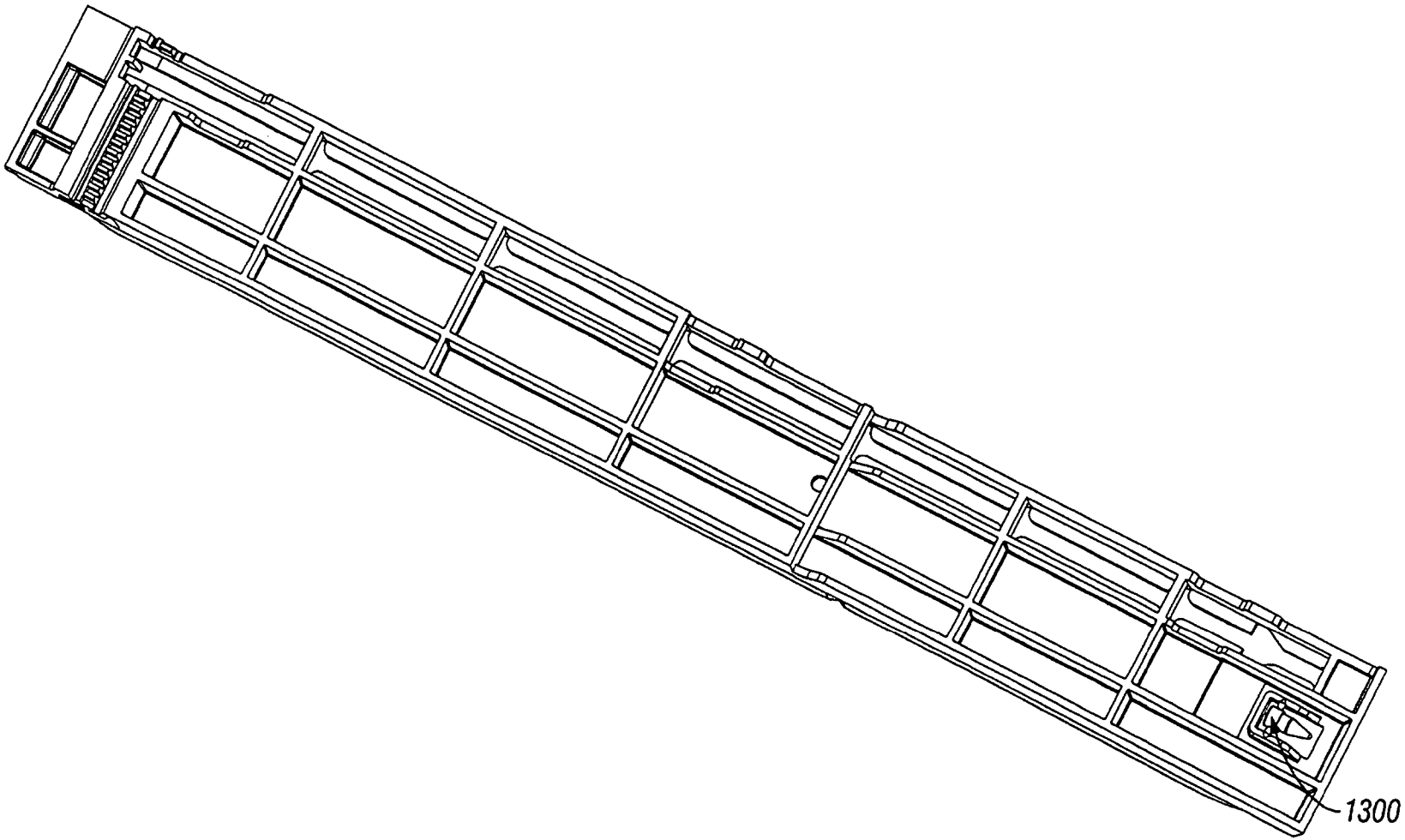
FIG. 9, is an enlarged view of the rear portion of the bottom of a T assembly in accordance with an illustrative embodiment of the invention.

After removing the rear portion of the T assembly 500 or any other base that may accept a pusher 700, the pusher 700 may be prevented from sliding out of the back of the pusher track by inserting a pin into hole 508. An exemplary pin 1300 is shown molded into the bottom rear portion of a base in FIG. 9.

Figure 4:
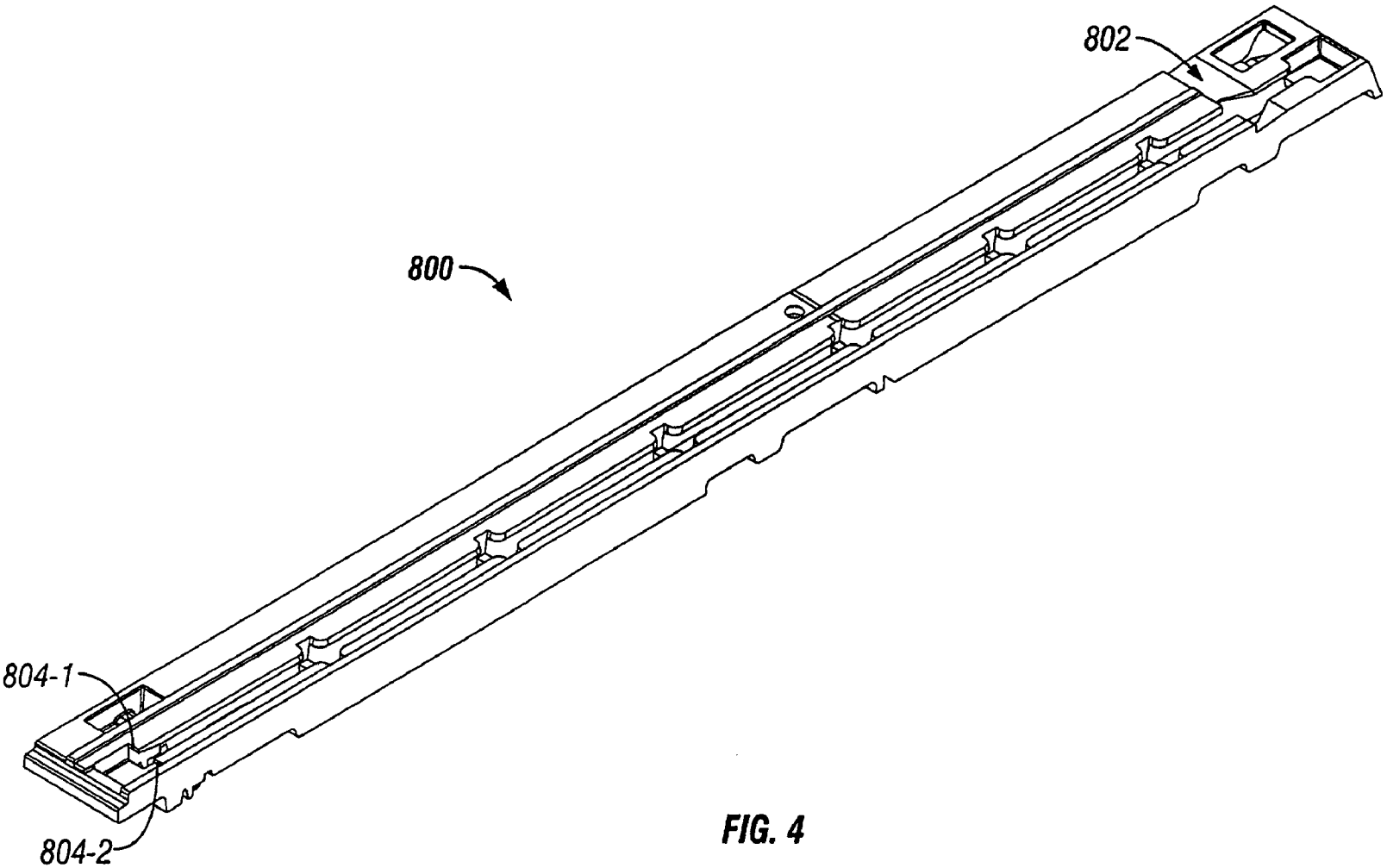
FIG. 4 shows a full-width track, also referred to as a base, which may be used with or without a pusher, in accordance with an illustrative embodiment of the invention.

Referring to FIG. 4, a depression 802 is shown. The depression 802 may be used, while re-stocking merchandise, to hold a pusher 700 near the back of a track 800 or a T assembly 500. To use the depression 802 to hold a pusher 700 at the back of the track 800, a person may move the pusher 700 back to the depression 802 and may tilt the top of the pusher 700 toward the front of the track 800, for instance, in a direction opposite of arrow 502 in FIG. 1. The depression 802 then holds the pusher 700 so that merchandise may be re-stocked without having to manually hold the pusher out of the way while placing the merchandise on the track surface. To remove the pusher 700 from the depression 802, the pusher may be pushed toward the back of the track 800, the pusher will then return to an upright position and move along the track 800 in its usual way.

Figure 12:
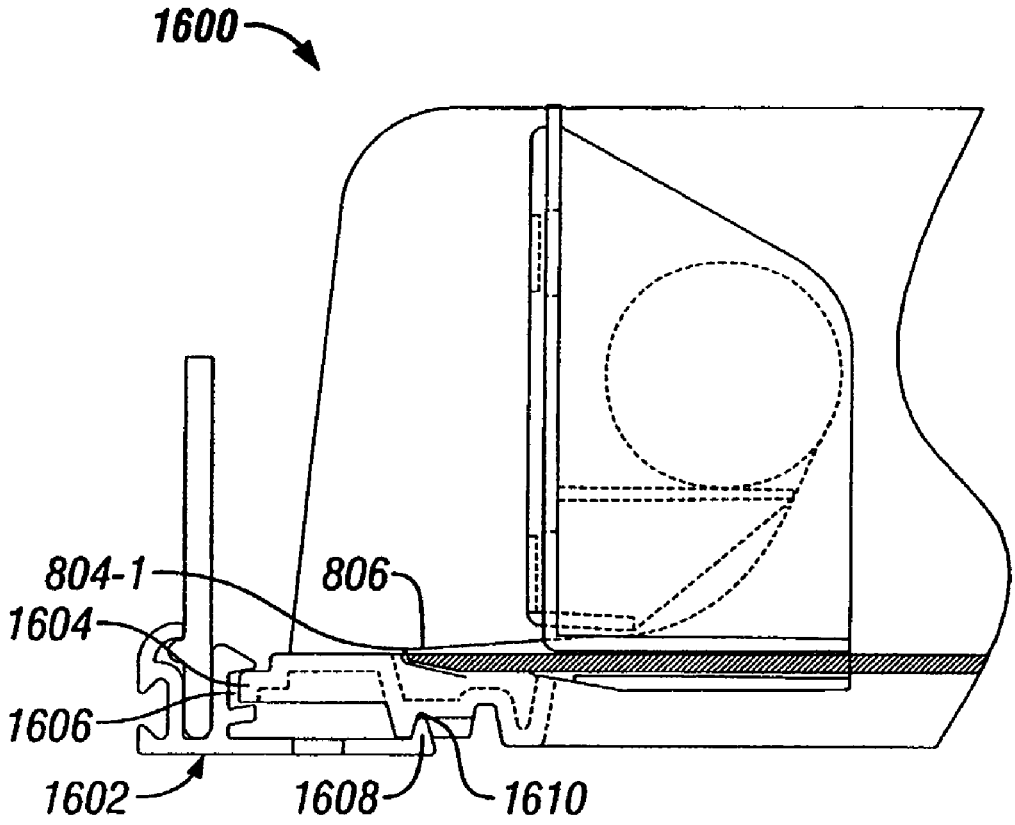
FIG. 12 is a partial side view of a cross-section of a bent end of a pusher's coiled spring engaging the front edge of a pusher track in accordance with an illustrative embodiment of the invention.

Front edges 804-1 and 804-2 of the respective surfaces that the pusher travels along may automatically engage a bent portion of the pusher's coiled spring when the pusher is inserted onto the front of the track 800. FIG. 12 is a partial side view of a cross-section of a bent end of a spring 806 engaging the front edge 804-1 of the track 800.

FIG. 12 also shows a complimentary tongue and groove engagement between a component 1600, which includes a pusher track, and a front rail 1602 in accordance with an illustrative embodiment of the invention. A tongue 1604 of the component 1600 engages a groove 1606 of the front rail 1602, and a tongue 1608 of the front rail 1602 engage a groove 1610 in the component.

While the invention has been described with respect to specific examples including presently preferred modes of carrying out the invention, those skilled in the art will appreciate that there are numerous variations and permutations of the above described systems and techniques that fall within the spirit and scope of the invention.

What is claimed is:

1. A merchandise-display system, comprising:

unitary, one-piece base-and-divider assembly for supporting displayed merchandise, wherein the base-and-divider assembly includes a base portion adapted for operative coupling to a shelf, and a divider portion for dividing displayed merchandise into rows, wherein the divider portion protrudes from the base such that the divider portion separates the base portion into a first portion having a pusher track and a second portion; and a spring-urged pusher in the pusher track for pushing merchandise along the first portion toward the front of the shelf.

2. The merchandise-display system of claim 1, wherein the base portion and the divider portion have respective removable breakaway portions for reducing a length of the base portion and a length of the divider portion.

3. The merchandise-display system of claim 2, wherein, with the breakaway portion of the base portion removed, a peg inserted into a hole near the back of the first portion prevents the pusher from sliding off the back of the pusher track.

4. The merchandise-display system of claim 1, wherein a front edge of the pusher track automatically engages a bent portion of a coiled spring of the pusher as the pusher is inserted onto the front of the pusher track.

5. The merchandise-display system of claim 1, wherein the pusher track includes a depression for holding the pusher near the back of the track in a shelf-stocking position.

6. The merchandise-display system of claim 1, wherein the pusher includes an offset portion positioned farther away from the divider portion than the distance between the divider portion and the pusher track.

7. The merchandise-display system of claim 6, wherein the offset portion is an upper portion of the pusher that is offset from a lower portion of the pusher by an angled offset portion.

8. The merchandise-display system of claim 1, when in the first portion of the base portion of the base-and-divider assembly is wider than the second portion of the base portion of the base-and-divider assembly.

9. The merchandise-display system of claim 8, further comprising: a base adapted for operative coupling to the shelf, wherein the base includes a pusher track.

10. The merchandise-display system of claim 1, further comprising: an integrated end component having a base portion and a divider portion, wherein the divider portion of the end component, the divider portion of the base-and-divider assembly, and the pusher cooperate to contain merchandise for display.

11. The merchandise-display system of claim 10, wherein the base portion of the end component supports a side of the first row of displayed merchandise opposite of the at least one side of the first row of displayed merchandise that is supported by the first portion of the base-and-divider assembly.

12. The merchandise-display system of claim 11, further comprising: a spring-urged pusher in the pusher track of the base.

13. The merchandise-display system of claim 12, further comprising: a spring-urged pusher in the pusher track of the base.

14. The merchandise-display system of claim 13, further comprising: gear teeth-like projections near the front of a bottom surface of the base-and-divider assembly engaged with gear teeth-like projections on an upwardly facing surface of the front rail.

15. The merchandise-display system of claim 14, further comprising:

a second integrated base-and-divider assembly having an offset pusher and adapted for operative coupling to a shelf, wherein the second base portion of the base-and-divider assembly supports a first side of a displayed product and a first base portion of the second base-and-divider assembly supports a side, which is opposite from the first side, of the product.

16. The merchandise-display system of claim 1, further comprising: a base adapted for operative coupling to the shelf, wherein the base includes a pusher track.

17. The merchandise-display system of claim 1, wherein the base-and-divider assembly is non-slidably engaged with a front rail that extends along and is affixed to a front portion of the shelf.

18. The merchandise-display system of claim 1, further comprising an integrated end component, which includes a base portion integrated with a divider portion, wherein the base portion of the end component is adapted for operative coupling to the shelf, and wherein the divider portion of the end component, the divider portion of the base-and-divider assembly, and a pusher in a pusher-track of the end component cooperate to contain merchandise for display.

19. The merchandise-display system of claim 18, wherein the base portion of the end component supports a side of the second row of displayed merchandise opposite of the at least one side of the second row of displayed merchandise that is supported by the second portion of the base-and-divider assembly.

20. The merchandise display system of claim 1, wherein the base portion is operatively coupled to shelf via a from rail.

21. The merchandise display system of claim 1, wherein the base portion is operatively coupled to a shelf via rail that is affixed to the shelf.

22. A merchandise-display system comprising:

an integrated base-and-divider assembly for supporting displayed merchandise, wherein the base-and-divider assembly includes a base portion adapted for operative coupling to a shelf, and a divider portion for dividing displayed merchandise into rows, wherein the divider portion protrudes from the base such that the divider portion separates the base portion into a first portion having a pusher track and a second portion; and a spring-urged pusher in the pusher track for pushing merchandise along the first portion toward the front of the shelf, wherein the base-and-divider assembly is non-slidably engaged with a front rail that extends along and is affixed to a front portion of the shelf.

23. A merchandise-display system comprising:

a base portion adapted for supporting merchandise, and a divider, the divider extending from the base portion at substantially a right angle, the base portion including a plurality of mating teeth, and wherein the base portion and the divider define a unitary, one-piece construction;

a pusher;

a rail with a plurality of mating teeth; and a pusher track comprising a top surface for supporting merchandise, and a depression near a rear portion of the pusher track for holding the pusher near the rear portion of the pusher track, wherein a portion of the plurality of mating teeth in the rail engage a potion of the plurality of mating teeth of the base portion to inhibit movement of the base portion in relation to the rail.

24. The merchandise-display system of claim 23 further comprising a coil spring and wherein the pusher track defines a first elongated rail, a second elongated rail, an aperture between the first elongated rail and the second elongated rail and a plurality of rib; connecting the first elongated rail and the second elongated rail.

25. The merchandise-display system of claim 23 wherein the plurality of mating teeth of the rail are thin and closely spaced.

26. The merchandise-display system of claim 25 wherein the plurality of mating teeth of the base portion are thin and closely spaced.

27. The merchandise-display system of claim 26 wherein the plurality of mating teeth of the rail are located at virtually continuous positions along the rail.

28. The merchandise-display system of claim 25 wherein the rail is configured to be mountable to a shelf.

29. The merchandise-display system of claim 28 wherein the rail is configured to be mountable to a front portion of a shelf.

30. A merchandise-display system comprising:

a unitary, one-piece base and divider assembly comprising a base and a divider, wherein the divider protrudes from the base and separates the base into a first portion and a second portion;

an assembly mounting member which comes into contact with the unitary, one-piece base and divider assembly;

a pusher track comprising a first rail with a top surface and a bottom surface, a second rail with a top surface and a bottom surface, an elongated aperture between the first rail and the second rail, a plurality of ribs connecting the first rail and the second rail, and wherein the first rail defines a plurality of notches and the second rail defines a plurality of notches;

a spring-urged pusher comprising a bottom engagement device, said bottom engagement device comprising a first flange and a second flange, wherein the first flange of the bottom engagement device comes into contact with the bottom surface of the first rail of the pusher track during operation of the system and wherein the second flange of the bottom engagement device comes into contact with the bottom surface of the second rail of the pusher track during operation of the system; and a coil spring which urges the spring-urged pusher forward.

31. The merchandise-display system of claim 30 wherein the pusher trick defines a front end and the coil spring defines a front portion and wherein the front end of the coil spring engages the front end of the pusher track.

32. The merchandise-display system of claim 30 wherein the integrated base and divider assembly defines a plurality of thin, closely spaced teeth.

33. The merchandise-display system of claim 32 wherein the pusher track defines a depression near a rear portion of the pusher track, and wherein the depression is configured to hold the spring-urged pusher near the rear portion of the pusher track during restocking.

34. The merchandise-display system of claim 32 wherein the assembly mounting member defines a plurality of thin, closely spaced teeth and wherein at least a portion of the plurality of teeth of the integrated base and divider assembly comes into contact with at least a portion of the plurality of teeth of the assembly mounting member during operation of the system.

35. The merchandise-display system of claim 34 wherein the spring-urged pusher further comprises a front face having a first edge and a second edge, the second edge having a top portion and a bottom portion, and wherein the first edge of the front face is nearer to the divider than the second edge of the front face during operation of the system and wherein the bottom portion of the second edge of the front face is nearer to the divider than the top portion of the second edge of the front face during operation of the system.

36. The merchandise-display system of claim 32 further comprising a front barrier designed to deter products from being pushed beyond the front barrier by the spring-urged pusher.

37. The merchandise-display system of claim 30 wherein the pusher track and the base and divider assembly form a unitary, one-piece construction.

38. A product display system comprising:

a base mountable to a shelf, the base defining teeth;

a track defining an elongated channel with spaced apart notches, the track including a retention portion near a rear portion of the track, the track configured to mount a pusher to the track, the retention portion configured to hold the pusher in a stationary position near the rear portion of the track; and a divider for dividing displayed product into rows, wherein the base and divider are formed as a unitary structure, the base and divider define a T-shaped configuration and the teeth of the base are configured to engage the teeth of a rail mounted to the shelf.

39. The product display system of claim 38 wherein the pusher further defines an offset pusher face and the retention portion of the track defines a depression.

40. The merchandise-display system of claim 38 wherein the rail is configured to be mountable to a shelf.

41. The merchandise-display system of claim 38 wherein the rail is configured to be mountable to a front portion of a shelf.

42. A product display system comprising:

a base mountable to a shelf, the base including a track and a depression, the track defining an elongated channel with spaced apart notches, the depression configured to hold a pusher near a back position on the track; and a T-shaped divider for dividing displayed product into rows, the T-shaped divider including a horizontal portion and a vertical portion, the vertical portion dividing the horizontal portion into a first portion and a second portion, the T-shaped divider defining teeth configured to mount the T-shaped divider to a rail, and wherein the teeth inhibit slidable movement of the T-shaped divider relative to the rail.

43. The product display system of claim 42 wherein the rail defines thin, closely spaced teeth configured to engage the teeth of the divider.

44. The product display system of claim 43 wherein the pusher comprises a pusher face and a bottom engagement device comprising a first flange and a second flange and wherein the first flange contacts the track and the second flange contacts the track during operation of the system.

45. A merchandise system comprising, an integrated base and divider assembly comprising an integral base and divider, wherein the divider is at an angle of approximately 90 degrees from the base and the base is configured to support merchandise during operation;

a pusher comprising a face having a first edge and a second edge, the second edge having a top portion and a bottom portion, and wherein the first edge of the face is nearer to the divider than the second edge of the face during operation of the system and wherein the bottom portion of the second edge of the face is nearer to the divider than the top portion of the second edge of the face during operation of the system;

a bottom rail; and a pusher track configured to be mounted to the bottom rail, the pusher track defining a first rail and a second rail, an aperture between the first rail and the second rail, a plurality of connectors that extend from the first rail to the second rail, and a depression near a rear portion of the pusher track configured to hold the pusher near the rear portion of the pusher track, wherein the integrated base and divider assembly is configured to be mounted to the bottom rail, and the base contacts the bottom rail during operation of the system to inhibit movement of the base in relation to the bottom rail.

46. The merchandise system of claim 45 wherein the pusher comprises a bottom engagement device, a first flange extending from the bottom engagement device and a second flange extending from the bottom engagement device, and wherein the first flange comes into contact with a bottom surface of the first rail of the pusher track during operation of the system and the second flange comes into contact with the second rail of the pusher track during operation of the system.

* * * * *